US005613442A

United States Patent [19]

Ahola et al.

[11] Patent Number: 5,613,442

[45] Date of Patent: Mar. 25, 1997

[54] ARRANGEMENT AND METHOD FOR MESURING AND CORRECTING THE LINE OF A TRACK

[75] Inventors: Raimo Ahola; Matti Tervaskanto, both of Oulu, Finland

[73] Assignee: Noptel Oy, Finland

[21] Appl. No.: 448,507

[22] PCT Filed: Dec. 22, 1993

[86] PCT No.: PCT/FI93/00555

§ 371 Date: Jun. 8, 1995

§ 102(e) Date: Jun. 8, 1995

[87] PCT Pub. No.: WO94/15024

PCT Pub. Date: Jul. 7, 1994

[30] Foreign Application Priority Data

Dec. 23, 1992 [FI] Finland ..... 925880

[51] Int. Cl.[6] ..... E01B 33/00

[52] U.S. Cl. ..... 104/8; 104/2; 33/287

[58] Field of Search ..... 104/2, 8, 7.1, 7.2; 33/286, 287

[56] References Cited

U.S. PATENT DOCUMENTS

| | | | |
|---|---|---|---|
| 3,706,284 | 12/1972 | Plasser et al. | 33/287 |
| 3,750,299 | 8/1973 | Plasser et al. | 33/287 |
| 3,795,056 | 3/1974 | Plasser et al. | 33/287 |
| 3,821,933 | 7/1974 | Plasser et al. | 104/8 |
| 3,922,696 | 12/1975 | Tyler et al. | 104/8 |
| 4,658,730 | 4/1987 | Beckmann et al. | 104/8 |
| 5,090,329 | 2/1992 | Theurer | 104/7.1 |
| 5,157,840 | 10/1992 | Henttinen | 33/287 |

FOREIGN PATENT DOCUMENTS

| | | | |
|---|---|---|---|
| 0213253 | 11/1987 | European Pat. Off. . | |
| 66987 | 8/1984 | Finland . | |
| 80790 | 3/1990 | Finland . | |
| 3444723 | 6/1986 | Germany . | |
| 365565 | 3/1974 | Sweden . | |
| 1204133 | 9/1967 | United Kingdom | 33/287 |
| A18907688 | 8/1989 | WIPO . | |

*Primary Examiner*—Mark T. Le
*Attorney, Agent, or Firm*—Nixon & Vanderhye P.C.

[57] ABSTRACT

The invention relates to an arrangement and method for measuring and correcting the line of a track. The method comprises forming an optical reference beam between an emitter on an emitter bogie and a position-sensitive receiver on a measuring and correcting car, moving the measuring and correcting car for a measurement interval in sequences of a desired length towards the emitter bogie, monitoring the movement of the hitting point of the optical beam by the position-sensitive receiver, measuring lateral inclination of the track, positioning the position-sensitive receiver in relation to the track between the sequences of moving, and measuring the instantaneous values of the position of the hitting point of the optical beam and the inclination of the track, and using the measurement data for the shifting operations directed to the track. The method further comprises measuring the position of the measuring and correcting car in the longitudinal direction of the track, which measuring is combined with position-sensitive optical measuring effected substantially without clearance in relation to the track for measuring the three-dimensional coordinates of the track substantially at the point of the track to which corrective shifting operations are directed.

14 Claims, 10 Drawing Sheets

ARRANGEMENT AND METHOD FOR MESURING AND CORRECTING THE LINE OF A TRACK

Figure 1:
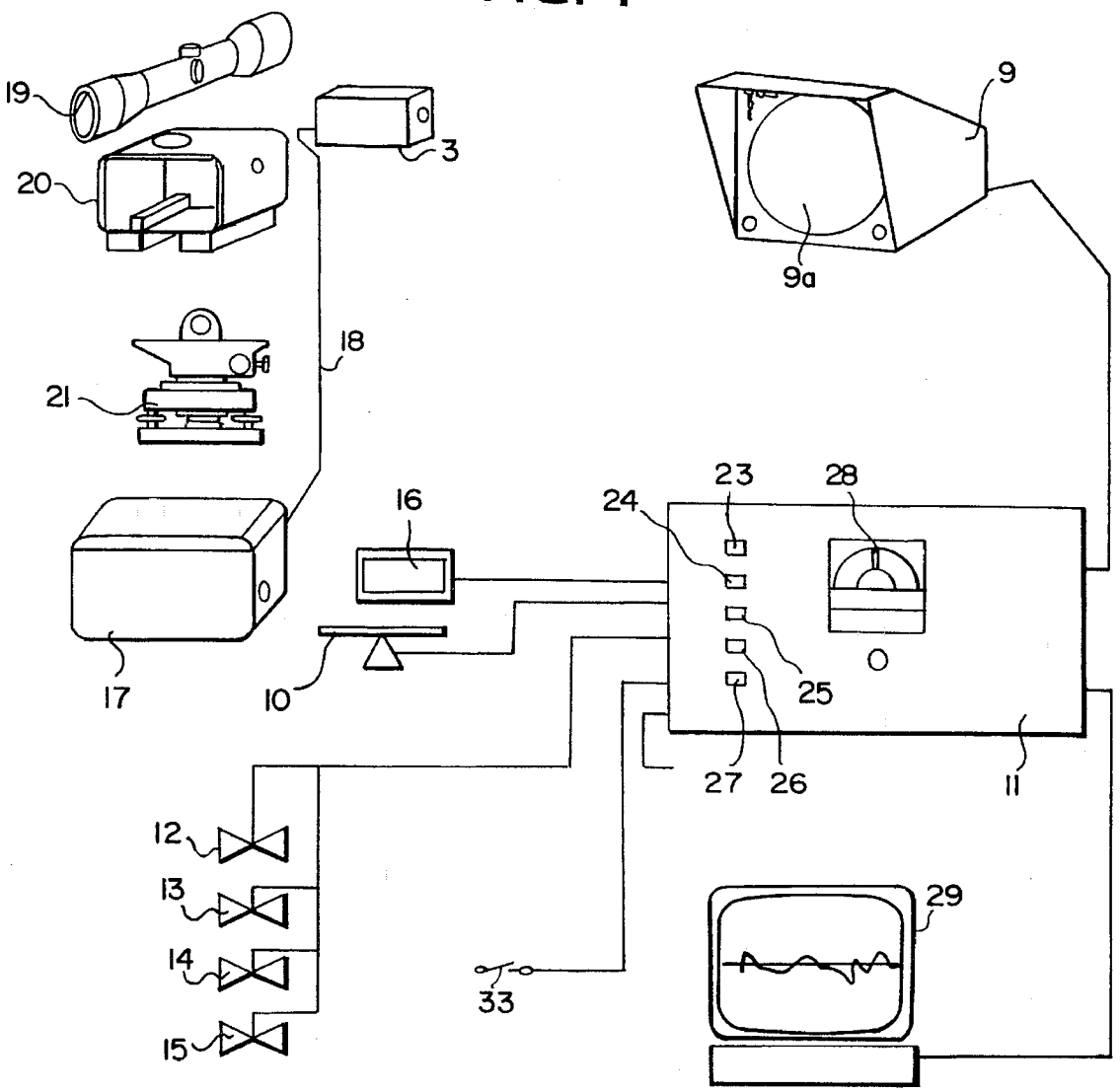

The invention relates to an arrangement for measuring and correcting the line of a track, said arrangement comprising an emitter bogie mounted on the track and provided with an emitter emitting substantially unidirectional optical radiation, a correcting car mounted on the track at a distance from the emitter bogie and provided with shifting elements for changing the line of the track, a measuring carriage provided in the correcting car and supported on the track, an optical position-sensitive receiver which is mounted on the measuring carriage and which substantially continuously measures the position of the optical beam on the measuring surface thereof and converts the measurement data into electric signals, a device provided in the correcting car for measuring lateral inclination of the track, a control unit connected to the position-sensitive receiver and the device which measures lateral inclination of the track for controlling the shifting elements, which change the line of the track.

The invention also relates to a method for measuring and correcting the line of a track, said method comprising forming an optical reference beam between an emitter on an emitter bogie and a position-sensitive receiver on a measuring and correcting car, moving the measuring and correcting car for a measurement interval in sequences of a desired length towards the emitter bogie, monitoring the movement of the hitting point of the optical beam by the position-sensitive receiver, measuring lateral inclination of the track, positioning the position-sensitive receiver in relation to the track between the sequences of moving, and subsequently measuring the instantaneous values of the position of the hitting point of the optical beam and the inclination of the track, and using the measurement data for the shifting operations directed to the track.

The arrangement which utilizes an optical beam, such as a laser beam, is a measuring and control system developed particularly for measuring and correcting the line of a track. The system controls lining, i.e. horizontal shifting, levelling, and also lateral inclination on the basis of given set values and measurement data. According to the system, a reference line is set between the laser emitter and the receiver; the current position of the measuring carriage in relation to the reference line is measured, and the control operations are then performed on the basis of the measurement results.

In known track measuring and correcting arrangements, the receivers of optical radiation merely detect the hit and are not so-called position-sensitive detectors (PSD) as in the present invention. The receivers which are used in known solutions and which detect only a hit or a miss are thus so-called zero point detectors, which detect whether a laser beam hits the receiver or not. In these known solutions the optical receiver mounted on a measuring carriage comprises, for example, several detectors which are not separately capable of measuring position but act as a receiver of an optical beam only when a plurality of them are positioned geometrically. Position data is thus obtained by geometrical positioning of a plurality of detectors, and there are separate zero point detectors for horizontal and vertical measuring. These solutions involve inevitably moving of the receiver and/or the emitter in order for the beam to be aligned with the detector. The purpose of the moving is to align and focus the optical axes of the emitter and the receiver with respect to each other. Mechanical moving retards the measuring. Individual detectors serve as so-called zero point detectors, i.e. they detect whether a laser beam hits them or not.

Movable receivers that are mechanically aligned with the beam are slow, which renders it more difficult to automate the arrangement. By zero point detectors it is also difficult to compensate for the effects of environmental conditions, as the beam often does not hit the receiving area of the detector. An example of the solutions described above is disclosed in U.S. Pat. No. 3,821,933, where the detector is self-centering, i.e. mobile transversely of the track, whereby deflection of the optical beam is used as the position data of the receiver. The receiver, or detector, is thus not in fixed connection with the rails. Other methods and apparatuses based on zero point detection of the receiver are disclosed in FI 80 790, SE 365 565 and EP 213 253.

Only DE 3 444 723 discloses a solution which, as the present invention, utilizes a position-sensitive receiver, or PSD detector. The solution disclosed in the cited reference is based on measuring the position of a laser beam on an optically position-sensitive surface and measuring the inclination of the track. The solution is based on the use of a so-called PSD Lateral Effect diode, which possesses a large optical surface, in accordance with the present solution, which utilizes the position-sensitive receiver technology disclosed in the Applicant's patent FI 66 987.

In the solution according to DE 3 444 723 the position-sensitive receiver-detector is, however, not disposed transversely in a fixed manner and without clearance in relation to the rails during the measuring but it is mounted on a separate mobile mechanical structure, whose vertical and horizontal distance from the rails is measured by sensors. In addition, in the above-mentioned solution the receiver-detector plane is positioned in the front of the correcting car; thus it cannot shift the line of the track and make measurements simultaneously as the point at which measuring is performed is different from the point at which shifting operations are directed to the track. Nor does the cited reference disclose measuring of the position of the receiver-detector plane in the longitudinal direction of the track. It is therefore obvious that by this solution it is not easy to implement automated measuring and simultaneous correcting based on the measuring especially in sharp curves and in switch areas. Nor does the cited reference disclose a solution by means of which the measuring area of the fairly large planar measuring surface of the position-sensitive detector could be further extended.

None of the known solutions involves three-coordinate measuring effected without clearance by a position-sensitive detector, and distance measuring in the longitudinal direction of the track at a point to be corrected.

The object of the invention is to provide a new type of arrangement and method which are used for measuring and correcting the line of a track and which avoid the problems pertaining to the known solutions.

This is achieved with an arrangement according to the invention, which is characterized in that the position-sensitive receiver, disposed at a point to which operations for changing the line of the track are directed by the shifting elements provided in the correcting car, is positioned substantially without clearance in relation to the track in the transverse direction of the track.

The above-mentioned object is also achieved with a method according to the invention, which is characterized in that it further comprises measuring the position of the measuring and correcting car in the longitudinal direction of the track, which measuring is combined with position-sensitive optical measuring effected substantially without clearance in relation to the track for measuring the three-dimensional coordinates of the track substantially at the point of the track to which corrective shifting operations are directed.

The method and arrangement according to the invention are based on the idea that the measuring data of the position-sensitive detector is obtained directly as so-called firsthand data from the point subjected to correcting operations, such as lining, i.e. horizontal shifting, levelling, or inclination, or a combination of these. Furthermore, an essential feature is that, in addition to the position data obtained by means of the data on the deviation of the beam in the x- or y-direction measured by the position-sensitive detector at exactly the right point, what is used in the calculation of the correcting operations is the measured distance of the position-sensitive detector in the longitudinal direction of the track in relation to a reference point. Thus the necessary shifts particularly in sharp curves and switch areas can be calculated more rapidly and more accurately, which facilitates automation of the arrangement.

The solution of the present invention affords several advantages, especially when the work is carried out in sharp curves and switch areas. The present solution enables substantially real-time measurement at exactly the right point of the track of all necessary parameters—including position data in the longitudinal direction—to be used as calculation data when the control unit controls the actuators which change the line of the track. The receiver, i.e. the position-sensitive detector, is fixedly mounted on a measuring carriage, wherefore the measuring data obtained are constantly actual firsthand measurement results correlating with the location of the measuring carriage and they are not dependent on the model or size of the measuring carriage or its position on the track. The system does therefore not require any auxiliary systems and is not dependent on their operation and calibration. The large optical position-sensitive measuring surface is particularly advantageous when a third type of measuring data, i.e. data on the location of the measuring carriage or correcting car in the longitudinal direction of the track, is included in the measurement. To use a position-sensitive optical surface considerably larger than the beam in practical measurements is particularly advantageous when the desired, accurately defined line or reference value of the track is other than a straight line; in this case, in addition to the data on the mutual angle of the rails and the transverse position, what is significant is the position data in the direction of travel of the machine, i.e. in the longitudinal direction of the track. It is thus necessary to define the transverse position data of the rails as a function of distance, i.e. the curvilinear line of the track. For instance, in curved and longitudinally inclined track sections it is not sufficient to use merely data on transverse deviation. In these cases, automatic correct determination of the line of the track expedites the working. The invention has been found to be particularly advantageous as compared with the known solutions in that it expedites the measuring and correcting and improves the accuracy especially when curved track sections are measured and corrected accurately as a function of distance.

Figure 2:
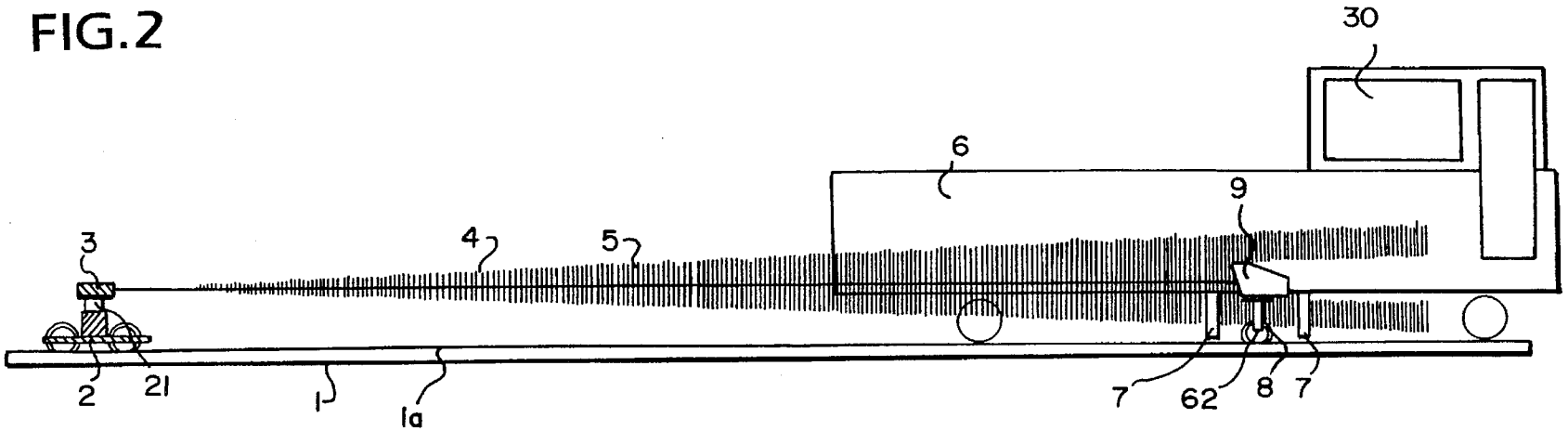
Figure 3:
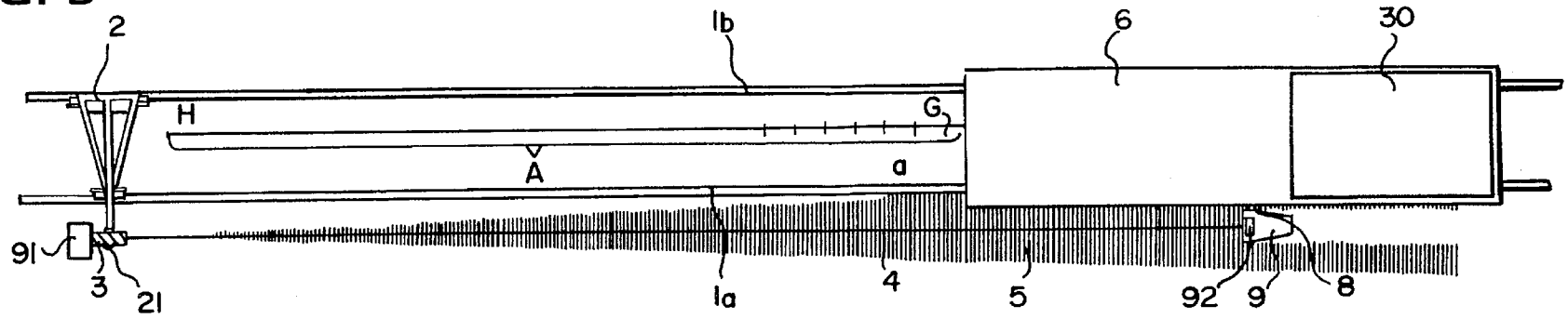
Figure 5:
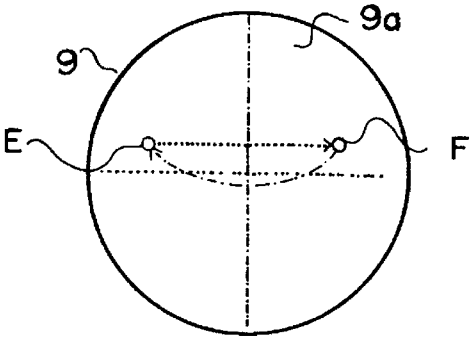
Figure 4:
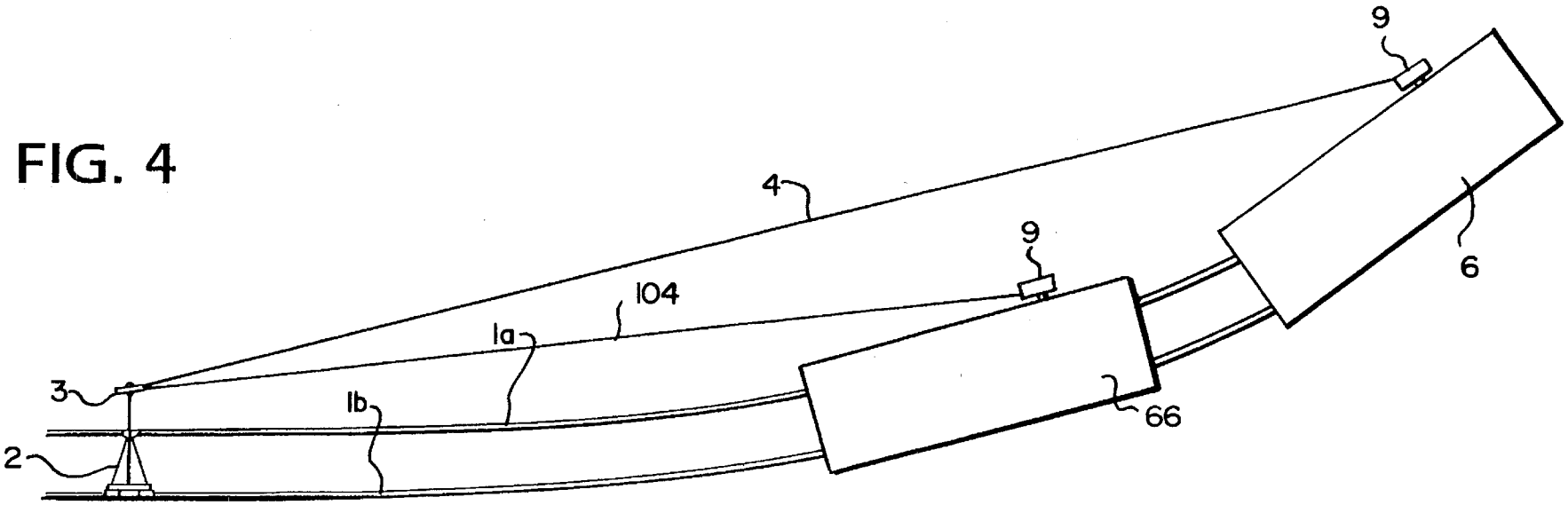
Figure 6:
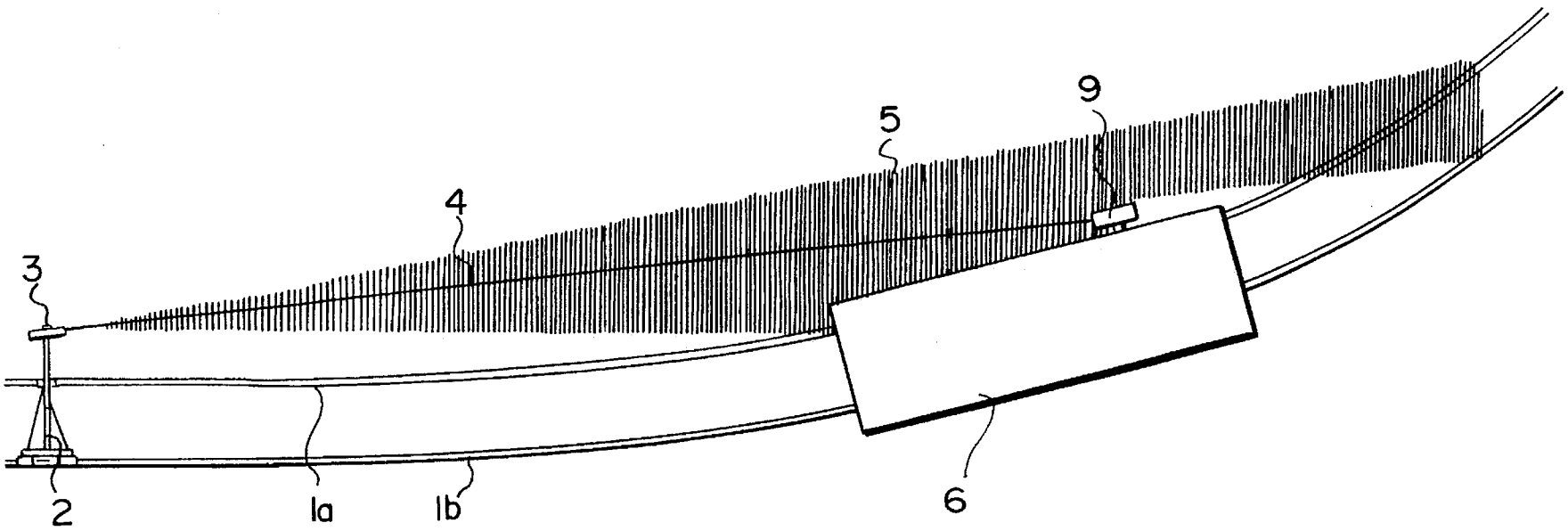
Figure 7:
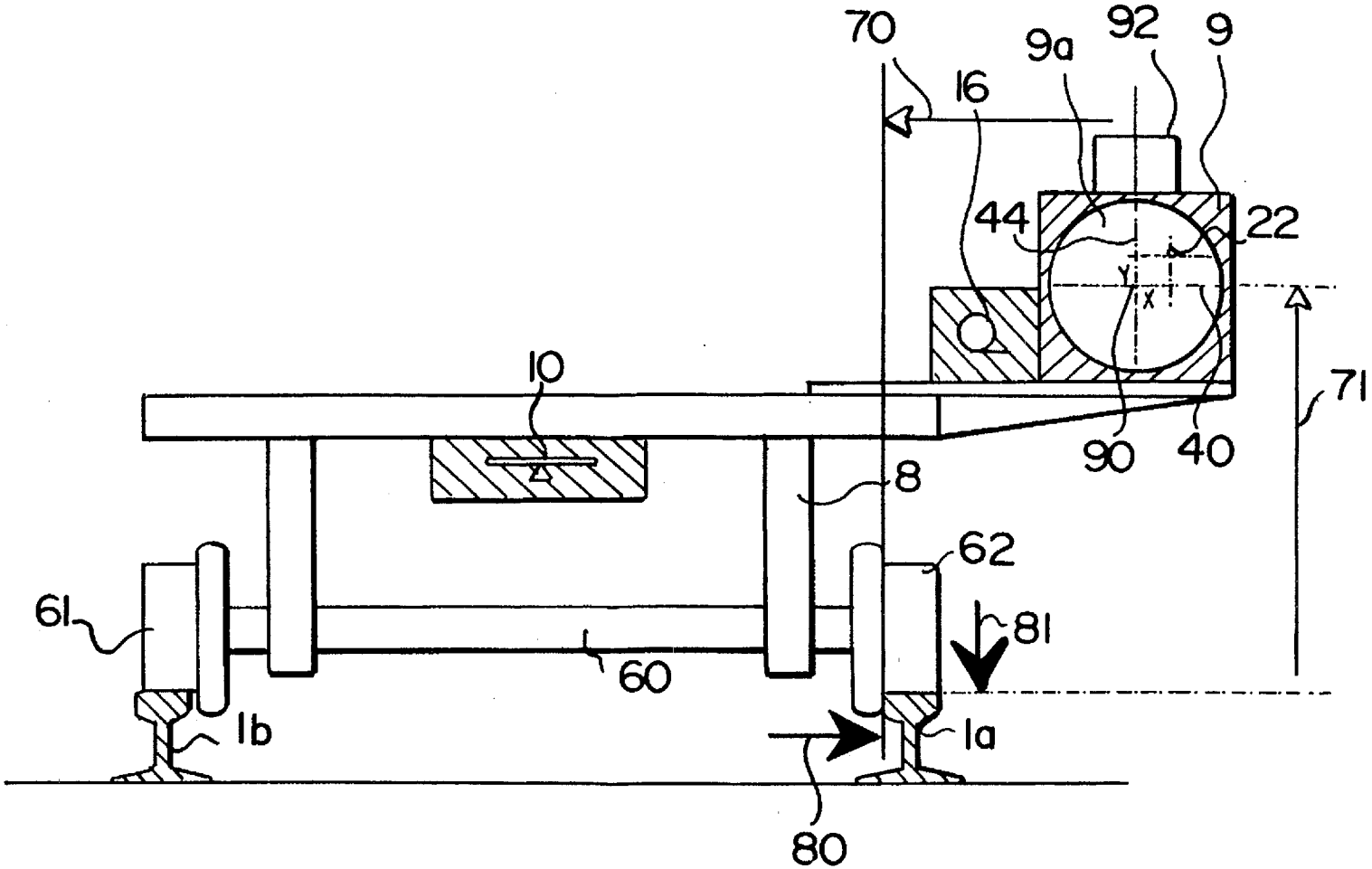
Figure 7A:
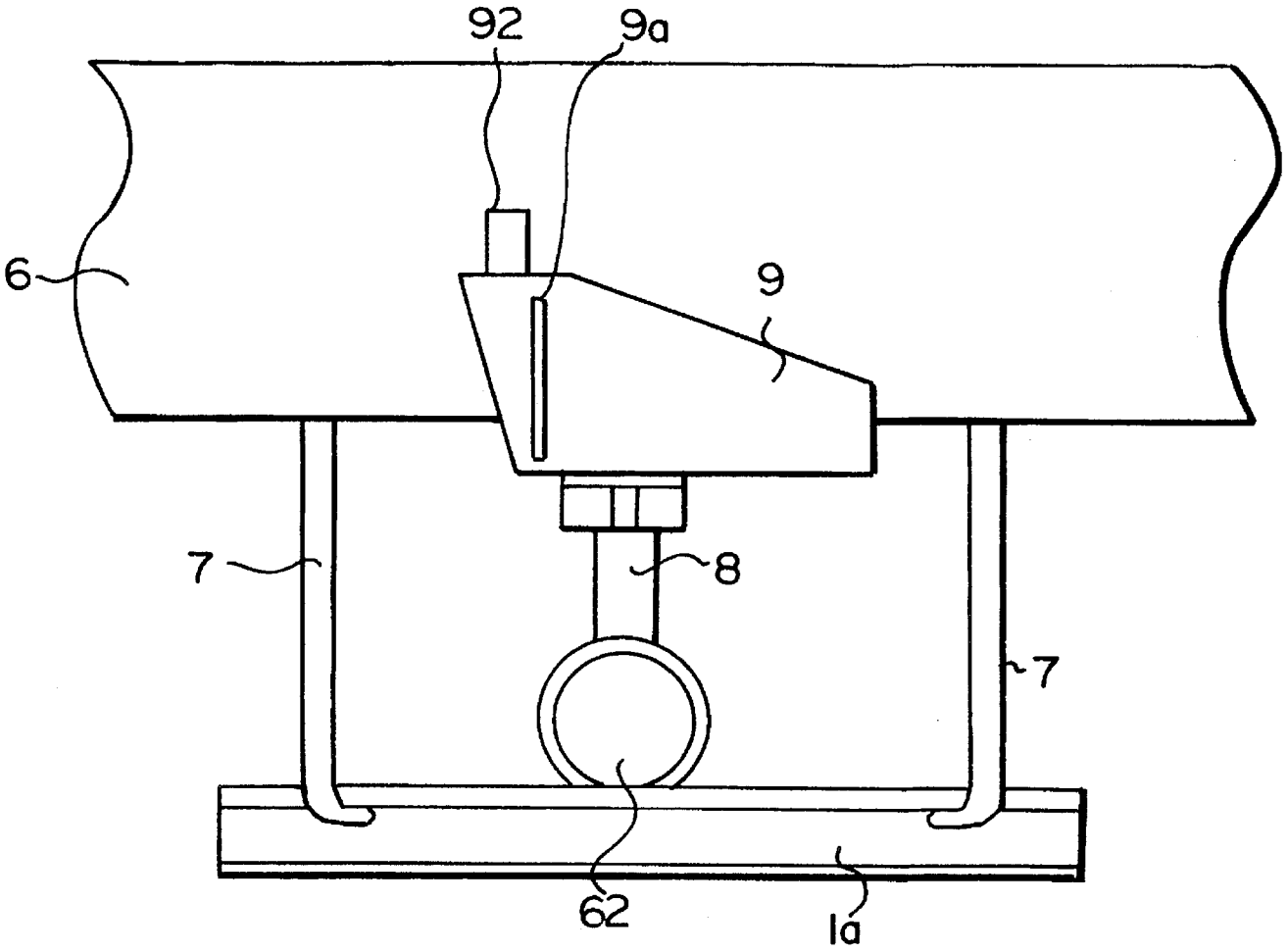
Figure 9:
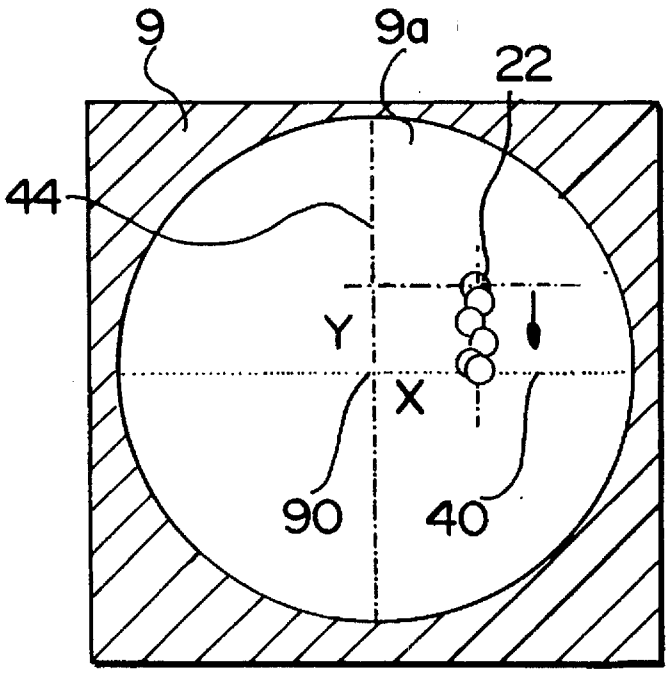
Figure 8:
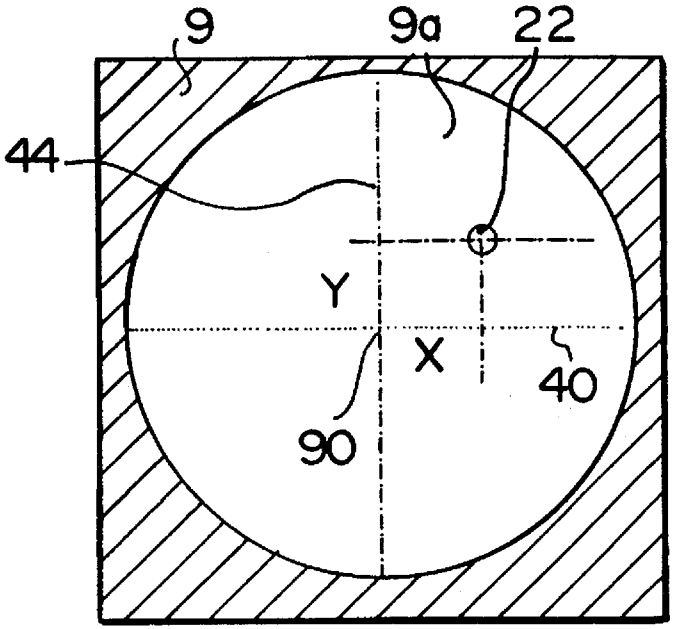
Figure 10:
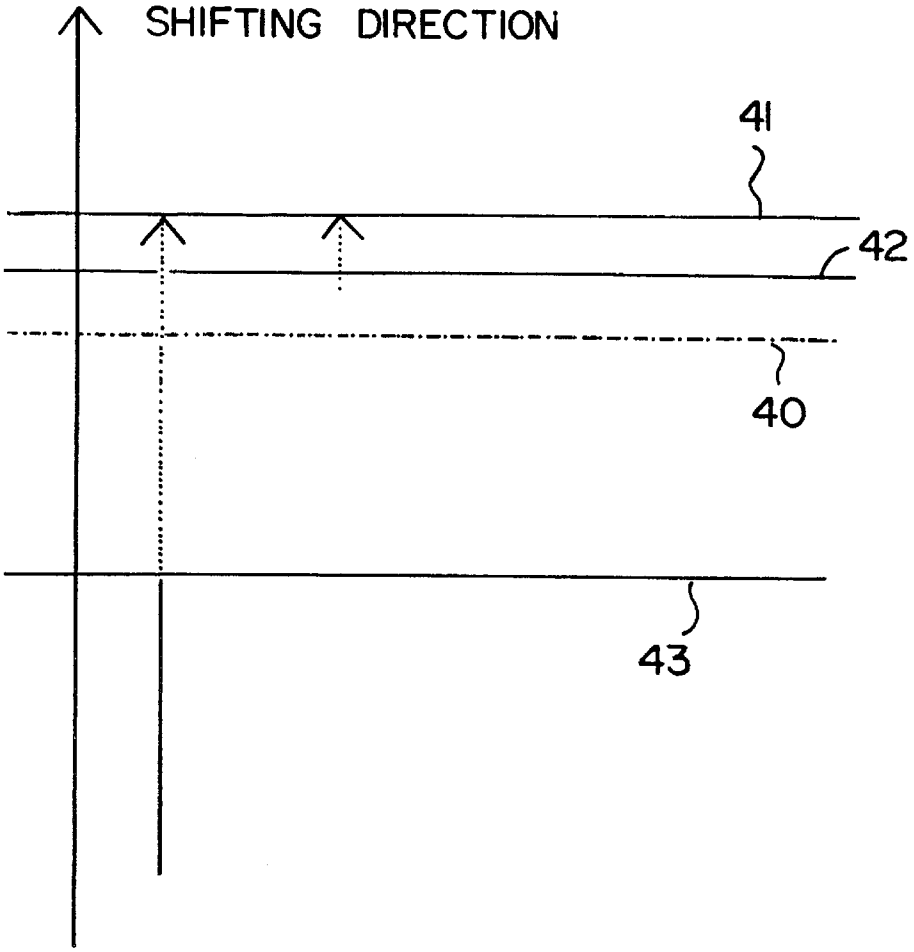
Figure 11:
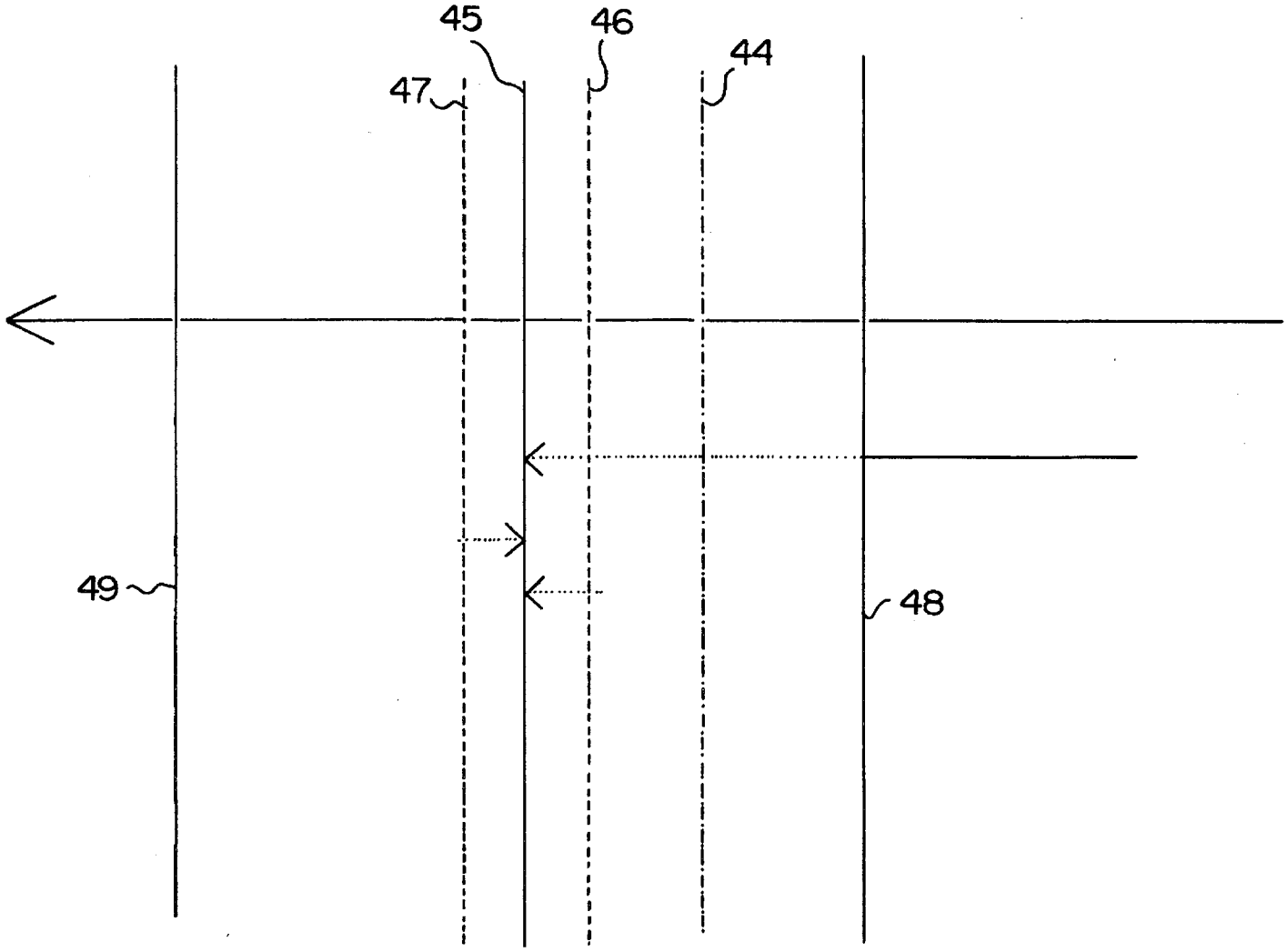
Figure 13A:
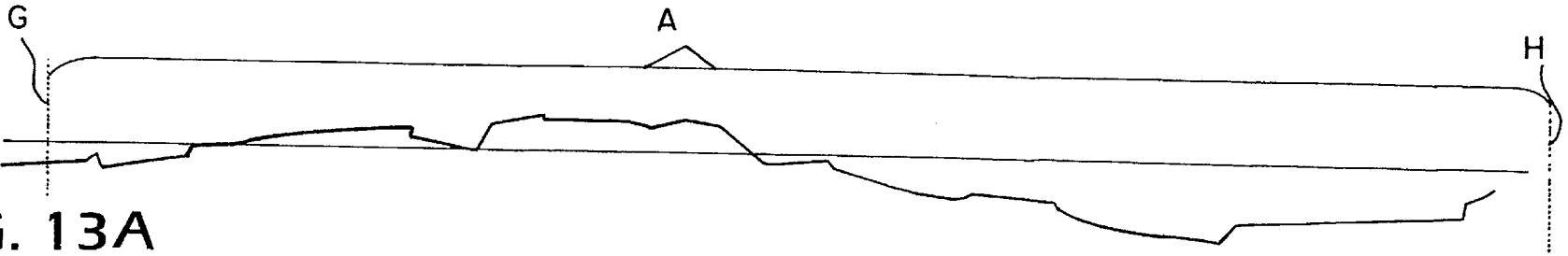
Figure 13B:
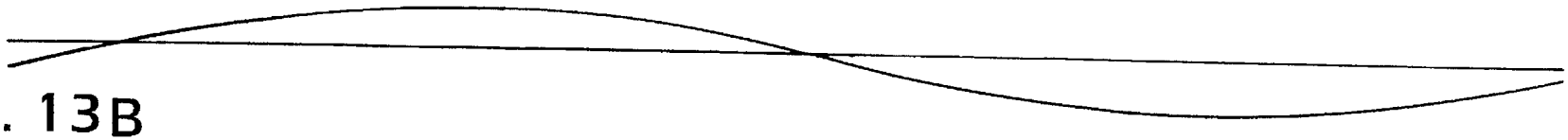
Figure 12:
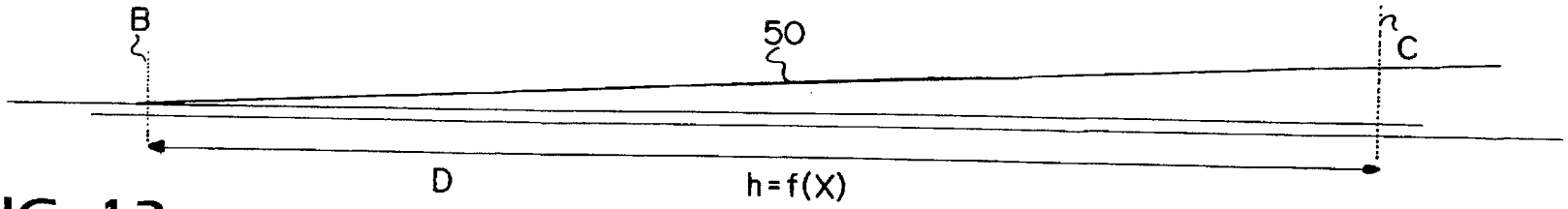

In the following, the invention will be described in greater detail with reference to the accompanying drawings, in which FIG. 1 is a general schematic view of the arrangement, FIG. 2 is a side view of an emitter bogie and a correcting car positioned on a track, FIG. 3 is a top view of the emitter bogie and the correcting car positioned on the track, FIG. 4 is a top view of the emitter bogie and the correcting car in a curved track section, FIG. 5 illustrates the screen of a position-sensitive receiver, FIG. 6 is a top view of the emitter bogie and the correcting car in a curved track section, FIG. 7 illustrates the location of the receiver on the measuring carriage when seen in the longitudinal direction of the track, FIG. 7a illustrates the location of the receiver on the measuring carriage when seen in the transverse direction of the track, FIGS. 8 and 9 illustrate the screen of a position-sensitive receiver, FIGS. 10 and 11 are shifting diagrams of levelling and lining, FIG. 12 is a diagram of longitudinal inclination, and FIGS. 13*a* and 13*b* illustrate rail profiles.

With reference to FIGS. 1 to 9, the arrangement is used for measuring the line and form of the track, and for controlling lining and levelling according to given set values and measurement data. A track 1 comprises a guide or reference rail 1*a* and a non-guide or non-reference rail, i.e. a rail 1*b* defining lateral inclination. The guide rail is thus the rail that is measured. The arrangement comprises an emitter bogie 2 which is mounted on the track 1 and on which there is disposed an emitter 3 emitting optical radiation, preferably a laser emitter which emits spotlike radiation and which can be utilized for simultaneous levelling and lining. Reference number 4 indicates a fixed, i.e. undeflected optical beam. Alternatively, the emitter may be a laser emitter 3 which emits a unidirectional fan-shaped, i.e. deflected, spot-like optical beam 5 and by which a wider area can be covered in levelling or lining. The use of a deflected beam 5 usually entails loss of measurement data in the direction of deflection. In practice, the arrangement comprises one emitter 3, which emits a spot-like modulated laser beam, which is either a fixed uni-directional beam 4 or a fan-shaped deflected one 5. In FIGS. 2, 3 and 6 the deflected, or fan-shaped, optical beam is indicated by reference number 5.

The arrangement further comprises a correction car 6 which is disposed on the track 1 at a distance from the emitter bogie 2 and which is provided with shifting elements 7 for changing the line of the track 1. By a mechanical movement the shifting elements 7 can effect lining, i.e. change the horizontal position of the track 1, lift the guide rail la or lift the nonguide rail 1*b*, or rail defining lateral inclination. By changing the position of the non-guide rail, or the rail defining lateral inclination, lateral inclination can be changed. The correction car 6 is provided with a measuring carriage 8 supported on the track 1. The arrangement further comprises an optical position-sensitive receiver 9 which is mounted on the measuring carriage 8 and whose measuring surface measures the position of the optical beam substantially continuously and which converts the position data into electric signals, e.g. a PSD Lateral Effect diode surface and suitable optics. The receiver 9 comprises a screen, indicated by reference number 9a in FIGS. 1, 5, 7, 8 and 9. The receiver 9, which has a large surface as compared with the beam 4, reads the position of the laser beam in the vertical and horizontal direction, i.e. in the x- and y-direction.

With reference to FIG. 7, in the preferred embodiment the position-sensitive optical receiver 9 is positioned or tolerance with respect to the track 1 in the transverse direction of the track, i.e., the receiver 9 is fixed relative to the track in the transverse direction. In addition, the optical position-sensitive receiver 9, which measures the position or hitting point 22 of the optical beam, is secured to the mechanics of the measuring carriage 8, which is fixedly connected to the track 1 during the measuring. The position of the position-sensitive receiver 9 in a plane perpendicular to the optical beam in relation to the track 1 remains substantially constant irrespective of whether the measuring carriage 8 and simultaneously also the correction car 6 are in motion or not- This solution ensures rapid and reliable measuring and facilitates automation of the measuring and correcting operations.

The arrangement also comprises a device 10, such as an inclinometer, for measuring lateral inclination, said device being mounted on the correcting car 6. The arrangement further comprises a control unit 11, which is connected to the position-sensitive receiver 9 and the device 10 for measuring lateral inclination, and which is arranged to control shifting elements 7, which change the line of the track 1. FIG. 1 illustrates two-position valves 12–15, which control the correction elements.

The arrangement according to the invention comprises a device 16 known per se, such as an odometer, for continuous determination of the position of the correcting car 6 in the direction of travel in relation to a reference point. The device 16 for determining the position of the correcting car 6 in the direction of travel is connected to the same control unit 11 as the position-sensitive optical receiver 9. The position-sensitive optical receiver 9, which measures the position of the optical beam in the x- and y-direction, is mounted substantially at that point of the correcting car 6 at which the line of the track 1 is changed by means of the shifting elements 7. In FIG. 2 this is implemented in such a manner that the receiver 9 is mounted symmetrically between two shifting elements 7, whereby the receiver 9 accurately detects the shifts of the track carried out.

The arrangement also comprises a battery unit 17 for generating voltage to the emitter 3, and a batterycable 18. In addition, the arrangement comprises a sighting telescope 19, a snap connection base 20, into which the laser emitter 3 is disposed, and an alignment base 21, by means of which the operator directs the beam to the middle of the receiver 9, utilizing the telescope 19.

The hitting point 22 of the beam on the receiver 9 is shown in FIGS. 7 to 9. With reference to FIGS. 1 to 9, the control unit 11 reads the position data of the laser beam hitting point 22 from the position-sensitive optical receiver 9 and the device 10 for measuring lateral inclination, and the reading of the odometer 16. On the basis of the data obtained, it controls the levelling and lining valves 12–15 of the arrangement. The valves 12–15, shown in FIG. 1, are arranged to control the track shifting elements 7, shown in FIG. 2. FIG. 9 illustrates the movement of the beam on the screen 9*a* of the receiver 9. Letters X and Y indicate the distance of the hitting point from the centre 90 of the screen 9*a*.

From FIGS. 2, 7 and 7*a* it can be seen that the measuring carriage 8 comprises an axle 60 and wheels 61 and 62, at which the measuring carriage 8 is supported on the rails 1*a* and 1*b*. The wheel 62 of the measuring carriage 8 is tightly pressed against the guide rail 1*a*. From the figures it can be seen that the position-sensitive receiver 9 and particularly its large receiving surface 8*a* are connected without clearance lateral tolerence to the rail 1*a* to be measured and simultaneously shifted. The position-sensitive receiving surface 9*a*, which is large in view of the size of the beam, and the actual receiver 9 are mounted on the part of the correcting car 6 where the shifting elements 7, e.g. clamps, are disposed, and at the same time substantially in alignment with the wheel 62 of the measuring carriage 8. In FIG. 7, arrow 70 indicates the perpendicular distance of the inner surface of the rail la from the vertical centre line 44 of the receiver 9. Arrow 71 indicates the perpendicular distance of the top surface of the guide rail la from the horizontal centre line 40 of the receiver 9. Arrows 80 and 81 indicate how the wheel 62 of the measuring carriage 8 is supported fixedly and substantially without lateral clearance relative to on the rail la to be measured and shifted. The large position-sensitive receiver 9 is thus in a direct mechanical contact substantially without clearance with the track 1. FIG. 7 also illustrates the device 10 for measuring lateral inclination, e.g. an inclinometer, and a device 16 for measuring the position of the measuring carriage 8 in the direction of the track, e.g. an odometer or an optical distance gauge.

The control unit 11 comprises control switches 23–27, by means of which the operator controls the operation of the correcting car 6 and the measuring carriage 8; from a gauge 28 included in the arrangement he sees the position of the guide rail 1*a*, or the rail to be measured, in relation to the laser beam. Furthermore, the arrangement comprises an actuator 29, such as a PC, by which the operator may give set values for levelling, lining or changing the lateral inclination and monitor graphically the line of the track in the vertical and horizontal direction.

The control unit 11 is disposed in the cab 30 of the correcting car 6 and comprises the logic with interfaces (not shown) necessary for controlling levelling and lining, control switches 23–27 for the operator, and a gauge 28. The control unit 11 either merely indicates the deviation from the selected measurement data by the gauge 28 or also controls the lining, levelling or lateral inclination, as the operator desires.

The actuator 29, for example a microcomputer, enables the line of the track 1 to be monitored by means of graphical presentation. It also enables the storage of data before and after correcting operations for comparison and checking, correcting of longitudinal inclination, adjustment of control for different types of tracks and track beddings, lateral inclination of the track, and additional levelling and shifting.

The actual measuring and correcting is performed in such a manner that when the measuring is started, the receiver 9 is placed on the side of the guide rail la. The emitter bogie 2 is moved to an appropriate place at a distance of from 50 to 200 meters from the correcting car 6 and is locked onto the track 1. The emitter 3 is directed by the use of the telescope 19 to the centre of the receiver 9. When the operation is started, the set values of the control unit 11 are set to zero.

The measuring and correcting operations consist of moving the correcting car 6 from the starting point G of a measuring interval A, consisting of a plurality of sequences a, to the terminal point H of the measuring interval A towards the emitter bogie 2. The measuring interval A and the measuring sequences a are shown in FIG. 3. After each sequence a, i.e. a distance of e.g. 0.5 m moved in the longitudinal direction of the track, the correcting car 6 with the measuring carriage 8 including the position-sensitive receiver 9 is positioned substantially without clearance to the track 1 to be measured. The position-sensitive receiver-detector 9 gives the position of the reference beam on the surface 9*a* of the receiver 9, and the odometer 16 gives the position of the receiver 9 in the longitudinal direction of the rails 1. An optical reference beam is thus formed between the emitter 3 on the emitter bogie 2, e.g. a carriage, and the position-sensitive receiver 9 on the measuring carriage 8 and the correcting car 6. The measuring carriage 8 and the correcting car 6 are moved for one measuring interval A in sequences of a desired length towards the emitter bogie 2. The movement of the hitting point 22 of the optical beam is monitored continuously, even hundreds of times in a second, by the position-sensitive receiver 9. The receiver 9, or in practice the measuring carriage 8, is positioned substantially without clearance with respect to the track 1 between the sequences a, and the instantaneous values of the hitting point 22 of the optical beam 4 and the inclination of the track 1 are measured. The position of the measuring carriage 8 and the correcting car 6 in the longitudinal direction of the track 1 is also measured in this connection by the odometer 16. The data obtained by the measurement of the position in the longitudinal direction is combined in the control unit 11 with the data obtained by the measurement of the beam position in the x- and y-direction on the position-sensitive receiver 9, and with the measurement data obtained from the device 10, e.g. an inclinometer, for measuring lateral inclination. These measurement data are combined before the shifting operations directed to the track 1 are carried out on the basis of these data. If it is observed by necessary calculations that the measurement data deviates too much from the desired values, the control unit controls the track shifting elements 7, e.g. clamps, through the valves 12–15. Lining, levelling or lateral inclination, or all of these operations together, are thus effected on the basis of the control. When the deviation is sufficiently small, the shifting movement in the shifting elements 7 stops and the line of the track 1 remains unchanged. Thereafter the operator releases the positioning which is substantially without clearance by a switch 33 for the shifting elements 7, said switch being connected to the control unit 11; then the operator drives the correcting car 6 one sequence, e.g. 0.5 m, closer to the emitter bogie 2. In the following sequences the operation is carried out correspondingly. The valves 12 and 13, shown in FIG. 1, connect the shifting elements 7, shown in FIGS. 2 and 7*a*, to lift the guide rail la or the rail 1*b* defining lateral inclination. The valves 14 and 15 in turn connect the shifting elements to effect lining of the rails.

By means of the switches 23–27 of the control unit 11 the operation of the arrangement can be controlled, for instance either by merely making measurements or, as in the present case, effecting control on the basis of the measurement results and set values given and the selections of the switches 23–27, and performing lining according to the horizontal measurement result obtained from the position-sensitive receiver 9 and the set value or target value for lining. The levelling of the guide rail 1*a* is carried out according to the vertical measurement result obtained from the position-sensitive detector 9 and the set value for levelling. The levelling of the non-guide rail, or the rail 1*b* defining lateral inclination, is carried out according to the measurement result obtained from the device 10, measuring lateral inclination, and the set value of the device. Each operation may be used either separately or together with the other ones.

In a preferred embodiment of the invention, the relative three-dimensional coordinates which unambiguously describe the line of the track 1 are calculated by calculation operations at the measuring and correcting point between the sequences a in relation to a reference point measured previously in the same measuring interval A. This method of measurement enables continuous measuring during the correcting operation carried out by the shifting elements 7 and a new, iteratively specified method of controlling the shifting elements 7, calculated by the control unit 11. The position of the hitting point 22 is thus determined by means of all of its coordinates, i.e. x-, y- and z-coordinates, as unambiguous, continuous and substantially simultaneous measurement data.

In the preferred embodiment of the invention, successive measurement intervals A are joined together by combining the last measurement of an interval with the first measurement of the following interval. A substantially continuous measurement of even several kilometers can thus be achieved, if desired.

With reference to FIGS. 4 and 5, in the preferred embodiment of the invention the receiving area of the receiver screen 9*a*, which is large as such, is extended during the measurement interval A by detecting that the hitting point 22 of the optical beam approaches point E on the edge of the receiver 9. Subsequently the receiver 9 is positioned substantially without clearance in relation to the track 1, and the hitting point 22 of the optical beam is transferred on the position-sensitive surface 9*a* of the receiver 9 until it is sufficiently far from the starting point E of the transfer, i.e. in point F. Finally the coordinates of the starting point E of the transfer are set to be identical with those of the terminal point F of the transfer. In this case, the extreme points of a curve and the radius relating to them are given from the PC for the control of lining, i.e. horizontal shifting. When shifting operations are performed in a curve, the PC calculates a set value which correlates with each distance and according to which the control unit controls the lining. When the beam crosses an alarm limit set on the edge, it is returned to the other edge as shown in FIG. 5. The lining is continued when new data on the position of the beam hitting point has been fed to the actuator, i.e. the PC, as the initial value for calculation. As shown in FIGS. 4 and 5, the lining of a curve can be controlled automatically within the size of the screen of the receiver 9 by giving the starting point and terminal point of the curve and the radius pertaining to them. When the laser beam crosses the alarm limit of the screen, i.e. comes too close to the edge, it is transferred to the other edge of the screen, and the lining is continued. On the basis of a beam which has hit the receiver 9, the direction of the emitter 3 can be changed in the middle of a measurement interval A; thus the beam is made to remain on the optical surface 9a of the receiver 9 during the entire measurement interval A. In FIG. 4 the correcting car is shown in two different locations, indicated by reference numbers 6 and 66. Reference number 66 indicates a chronologically later location of the correcting car. In FIG. 4 the correcting car 6 has been moved several times in sequences towards the emitter 3 in a sharp curve. It is obvious that in a curve the beam 4 tends to move away from the receiver 9; the emitter 3 has therefore been inclined several times in small steps within the limits set by the receiver 9 in order that the hitting point of the beam should be maintained on the screen 9*a* of the receiver 9. Finally the beam emitted by the emitter 3 has inclined from the position indicated by reference number 4 to the position indicated by reference number 104. In the preferred embodiment, the arrangement comprises means 9, 11, 29 for detecting that the hitting point 22 of the optical beam approaches the edge of the screen 9*a* of the position-sensitive receiver 9, means 21 for transferring the hitting point 22 of the optical beam on the measuring surface 9*a* of the receiver 9, and means for transmitting data between these means. The detecting means consist preferably of the actual receiver 9 and the control unit with the actuator 29 connected to it, by means of which it can be detected if the coordinates of the hitting point cross the alarm limit. The means for transferring the hitting point 22 consists preferably of an alignment base 21 of the emitter or, for instance, of optics by means of which the beam can be turned. The means for transmitting information between the detecting means 9, 11, 29 and the base 21 may be, for example, a radio transceiver or an optical transceiver. In FIGS. 2, 3, 7 and 7*a* the optical transmitter or radio transmitter on the measuring carriage 8 is indicated by reference number 92. The optical receiver or radio receiver on the emitter bogie, or emitter carriage 2, is indicated by reference number 91. The optical receiver or radio receiver 91 may control the inclination of the beam 4 emitted by the emitter 3 on the basis of a signal obtained from the transmitter 92 by controlling, for instance, the inclination of the alignment base 21 of the emitter 3 or a possible electric motor (not shown) for inclining possible additional optics.

In accordance with FIG. 6, levelling is controlled in a curve by the use of an emitter 3 emitting a fan-shaped, horizontally deflected beam 5. Horizontal deflection on a straight track section is illustrated in FIG. 3, and vertical deflection for controlling lining, or horizontal shifting, of a straight track section is shown in FIG. 2.

The actuator 29 shown in FIG. 1 gives limit values and windows for levelling, lining and correction of lateral inclination, which the control unit uses in the control operations. When the operation is started, the limit values are set to their basic values and, if necessary, the operator can change them by means of the actuator 29.

FIG. 10 is a shifting diagram of the levelling of the guide rail. Several horizontal lines are shown in FIG. 10. Line 40 represents the x-axis, or centre line, of the receiver, which is also shown in FIG. 7. The centre line represents the zero level. Line 41 indicates the levelling limit, i.e. the height to which the rail is to be lifted. The levelling limit may be set, for example, to 2 mm above the centre line. Line 42 illustrates the zero limit, which is set to e.g. 1 mm below the levelling limit 41. Line 43 illustrates a retardation limit, which is set to e.g. 5 mm below the levelling limit 41. In the preferred embodiment of the invention (see FIG. 10 and FIGS. 2 to 7), the levelling of the guide rail 1*a* is started when the levelling operation has been selected and the activation of the control signals has been allowed, and when the operator has secured the shifting elements 7, such as clamps, to the track 1, and when the rail according to the measurement is below the set value. If the position of the track 1 in the vertical direction is below the retardation limit 43, e.g. 5 mm, the levelling is controlled with full power until the retardation limit 43 is achieved. After the retardation limit 43, the control power directed to the shifting elements 7 and through them to the track 1 is reduced. The levelling is stopped when the track 1 reaches the set value, but it will be continued again if the track 1 during the working falls below the zero limit 42, which may be 1 mm below the levelling limit 41, as stated above. This embodiment provides an easy way of eliminating too high exceedings and of ensuring, on the other hand, that the shifting of the track 1 to the correct position does not cause an irremediable error in the measurement and correction. The difference of 5 mm between the levelling limit 41 and the retardation limit 43 forms a so-called window, which the operator may give from the actuator 29 as initial values.

FIG. 11 is a shifting diagram of the track 1 in lining, or horizontal shifting. Several vertical lines are shown in FIG. 11. Line 44 represents the y-axis, or centre line, of the receiver, which is also indicated in FIG. 7. The centre line 44 represents the zero level. Line 45 indicates the lining limit, i.e. the horizontal position to which the track 1 is to be shifted. The lining limit 45 may be e.g. 4 mm. A right and a left adjustment limit 46 and 47 are provided on both sides of the lining limit 45, e.g. at a distance of 1 mm from the lining limit 45. The outermost lines are a right and a left retardation limit 48 and 49, set at a distance of e.g. 5 mm from the lining limit 45 on both sides thereof. In the preferred embodiment of the invention (see FIG. 11 and FIGS. 2 to 7), the lining is started when the lining operation has been selected and the activation of the control signals has been allowed, and when the operator secures the shifting elements 7, or clamps, to the track 1. The lining is effected in the direction determined by the value of the measurement preceding the activation; i.e. if the track 1, according to the measurement, is too far left, it is controlled to the right, and vice versa. If the track 1 is beyond the retardation limit 48 or 49, the lining is controlled with full power until the retardation limit 48 or 49 is achieved, whereby the control power is reduced. The lining is stopped when the track 1 achieves the set value, i.e. the lining limit 45, but it will be continued again if the track 1 during working shifts beyond the adjustment limit 46 or 47. The lining direction is always selected anew according to the measurement result. The advantages of this embodiment correspond to those of the levelling described above.

In the above-described preferred embodiments of the invention it is essential that the shifting elements 7 are controlled by the control unit 11 in such a manner that the track 1 is shifted with high power to the initial value given by the actuator 29 sufficiently close to the set value 45 and subsequently with a considerably lower control power to a position slightly beyond the set value 45. If the position of the track 1 during the shifting changes too much with respect to the second set value given by the actuator 29, the shifting is started anew. This embodiment can be implemented by the positioning of the position-sensitive detector 9 according to the invention and the method according to the invention.

The levelling and lining are carried out either according to set initial values or according to set values given previously by the actuator, or the PC 29.

With reference to FIG. 12, for correcting longitudinal inclination, the actuator 29 gives the distance D between the starting and terminal points B and C of the longitudinal inclination 50, and the equation for calculating the longitudinal inclination h=f(x). On the basis of the measurement data obtained from the position-sensitive detector 9, the inclinometer 10 and the means for measuring the position of the correcting car 6 in the direction of the track, the actuator 29 calculates a set value dependent on the distance in the direction of the track and controls thus the operation of the control unit 11. The longitudinal inclinations 50 can be formed as, for example, direct inclinations or S-inclinations.

With reference to FIGS. 13*a*–13*b*, in the preferred embodiment of the invention, prior to the actual shifting operations directed to the track 1, the correcting car is moved for a desired measuring interval A towards the emitter 3, during which time only measuring of the line of the track 1 is conducted in order for measurement results to be obtained. Thereafter the correcting car is moved back for the measurement interval A, and the measurement results are processed in such a manner that the operator gives the necessary limit values or the like. The limit values can be given before the measurement, whereby they are stored in the actuator or in the control unit. Alternatively, the limit values can be given after the measurement but before the correcting operations, as stated above. The limit values may be, for instance, values pertaining to the radius of a curve or the radius of a longitudinal inclination of the track 1 or to other corresponding values. The actual measuring and correcting operations are carried out on the basis of the processed measurement results. Instead of normal set values, the target values, or set values, used in the present invention are measurement data that have been obtained by measuring and that have been appropriately processed, for example, by the use of limit values given by the operator. The invention may be used, for instance, in connection with an irregularly undulating levelling profile, whereby the line of the track 1 is measured as a function of distance. A levelling profile which is filtered and corrected on the basis of the limit values given by the operator (FIG. 13*b*) is calculated from the measurement results according to FIG. 13*a*, i.e. the measured profile; the corrected levelling profile is used for controlling the levelling. The actuator 29 Calculates a set value correlating with each distance and, on the basis of these set values, controls the operation of the control unit 11. On the basis of the measurement of the irregular levelling profile and the calculation of the new profile, the track 1 is automatically given a new actual profile. The preferred embodiment of the method described above is also suitable for use in measurement of curves with an irregular profile, calculation of a new corrected profile based on measurement and limit values, and when the corrected profile is used for the correction of a curve. In the preferred embodiment of the method concerned, the corrected track profile (FIG. 13*b*) is calculated as a function of the longitudinal distance of the track 1 by processing the measurement results; in the actual correcting operation, the position of a rail or a track 1 is shifted at each distance measured again in the measurement interval A to correspond with the computationally corrected profile. This preferred embodiment improves the applicability of the invention in difficult track sections to be corrected and utilizes efficiently the other features of the solution according to the invention.

The expression correcting the line of a track refers to levelling, lining and/or lateral inclination of a rail or a track so that it becomes straight or curved as desired.

Although the invention has been described above with reference to the examples illustrated in the accompanying drawings, it will be clear that the invention is not limited to them but can be modified within the basic concept disclosed in the appended claims.

We claim:

1. In apparatus for measuring and correcting a line of a track including an emitter bogie mounted on the track and provided with an emitter adapted to emit a substantially unidirectional optical beam;

a correcting car mounted on the track at a distance from the emitter bogie and provided with shifting elements for changing the line of the track;

a measuring carriage provided in the correcting car and supported on the track;

an optical position-sensitive receiver mounted on the measuring carriage and which substantially continuously measures a position of an optical beam from the emitter on a measuring surface of a screen and converts measured position data into electric signals;

a device provided in the correcting car for measuring lateral inclination of the track; and a control unit connected to the optical position-sensitive receiver and to the device which measures lateral inclination of the track, said control unit being arranged to control said shifting elements;

an improvement wherein the optical position-sensitive receiver is positioned, at least during measuring, in substantially constant positioned relationship relative to the track in a transverse direction of the track such that said optical position-sensitive receiver is secured to said measuring carriage at least during measuring in such a manner that the position of the position-sensitive optical receiver in a plane perpendicular to the beam in relation to the track remains continuously substantially constant.

2. Apparatus according to claim 1, and further comprising a device for continuously determining position of the correcting car in a direction of travel in relation to a reference point, said device being connected to said control unit for controlling said shifting elements, and wherein the device for measuring lateral inclination is provided at a point where the line of the track is measured and corrected so as to obtain three-coordinate measurement and correction data.

3. Apparatus according to claim 1, wherein the optical position-sensitive receiver is positioned, in a direction of the track, in close proximity to said shifting elements.

4. Apparatus according to claim 1, and further comprising first means for detecting when the position of the optical beam approaches an edge of the screen of the position-sensitive receiver, second means for transferring the position of the optical beam on the screen, and third means for transmitting data between said first and second means.

5. A method for measuring and correcting a line of a track, said method comprising the steps of:

a) forming an optical reference beam between an emitter on an emitter bogie and a position-sensitive receiver on a measuring and correcting car, b) moving the measuring and correcting car for a measurement interval (A) in sequences of a desired length in relation to the emitter bogie, c) monitoring movement of a hitting point of the optical beam on a screen of the position-sensitive receiver, d) measuring lateral inclination of the track, e ) positioning the optical position-sensitive receiver in relation to the track between sequences of moving, and measuring instantaneous values of the position of the hitting point of the optical beam and the inclination of the track, and f) using said values for shifting operations directed to the track; wherein the position of the position-sensitive receiver is continuously kept substantially constant at least during measuring by the use of the position-sensitive optical receiver which is positioned in substantially fixed relationship relative to the track in a transverse direction of the track.

6. A method according to claim 5, wherein the measuring performed by the optical position-sensitive receiver is performed at substantially that point of the track at which said shifting operations for changing the line of the track are directed, further wherein three-dimensional coordinates (x, y, z) of the track are measured by the optical position-sensitive measuring performed at said point and by carrying out measuring of the position of the measuring and correcting car in the longitudinal direction of the track.

7. A method according to claim 6, and further comprising the step of;

g) combining data on the position in the longitudinal direction of the measuring and correcting car with the data on the position of the beam on the position-sensitive receiver screen and with the measurement data on the inclination of the track prior to performing said shifting operations.

8. A method according to claim 5, wherein the three-dimensional coordinates are calculated by calculation operations at each measuring and correction point between sequences in relation to a reference point measured previously during the same measuring interval.

9. A method according to claim 8, in which the emitter is moved between measurement intervals, wherein successive measurement intervals are joined together by combining a last measurement of an interval with a first measurement of a following interval.

10. A method according to claim 5, wherein the receiving area of the position-sensitive receiver screen is extended during the measurement interval by detecting when the optical beam approaches the edge of the position-sensitive receiver screen, positioning the receiver substantially without clearance in relation to the track, and transferring the optical beam on the surface of the receiver until it is sufficiently far from the starting point of the transfer, and setting the coordinates of the starting point of the transfer to be identical with those of the terminal point of the transfer.

11. A method according to claim 5, wherein prior to the shifting operations directed to the track, the correcting car is moved for a desired measurement interval towards the emitter, during which time only measuring of the line of the track is conducted in order for measurement results to be obtained; the correcting car is moved back for the measurement interval (A); the measurement results are processed by giving necessary limit values; and the actual correcting of the line of the track is effected by driving said measurement interval again and using the processed measurement results as target values when the line of the track is changed.

12. A method according to claim 11, wherein a corrected track profile is calculated as a function of the longitudinal distance of the track by processing the measurement results, and wherein, in the actual correcting operation, the line of the track is shifted at each distance measured again in the measurement interval to correspond with a computationally corrected track profile.

13. A method according to claim 11, wherein the shifting elements are controlled by the control unit in such a manner that the track is shifted with high power to a given initial value sufficiently close to a target value, and subsequently the line of the track is changed with a considerably lower control power at least to the target value.

14. A method according to claim 13, wherein if the position of the track during shifting changes too much from the target value in relation to a given second set value, the shifting is started anew.

* * * * *